US007159437B2

(12) United States Patent
Schroth et al.

(10) Patent No.: US 7,159,437 B2
(45) Date of Patent: Jan. 9, 2007

(54) HEATED DIE FOR HOT FORMING

(75) Inventors: James G. Schroth, Troy, MI (US); Richard H. Hammar, Utica, MI (US)

(73) Assignee: General Motors Corporation, Detroit, MI (US)

( * ) Notice: Subject to any disclaimer, the term of this patent is extended or adjusted under 35 U.S.C. 154(b) by 5 days.

(21) Appl. No.: 10/960,484

(22) Filed: Oct. 7, 2004

(65) Prior Publication Data

US 2006/0075799 A1 Apr. 13, 2006

(51) Int. Cl.
*B21D 37/16* (2006.01)
*B21D 39/20* (2006.01)

(52) U.S. Cl. ..... 72/342.8; 72/342.92; 72/364; 72/709; 76/107.1

(58) Field of Classification Search ..... 72/54, 72/57, 60, 342.1, 342.4, 342.7, 342.8, 342.92, 72/364, 476, 709; 76/107.1
See application file for complete search history.

(56) References Cited

U.S. PATENT DOCUMENTS 3,528,276 A * 9/1970 Hedstrom et al. ..... 72/342.92
3,926,029 A * 12/1975 Abson et al. ..... 72/342.92
4,888,973 A * 12/1989 Comley ..... 72/342.92
5,277,045 A 1/1994 Mahoney et al. ..... 72/60
6,272,894 B1 * 8/2001 Hudson et al. ..... 72/61
6,810,709 B1 * 11/2004 Hammar et al. ..... 72/342.7
6,884,966 B1 * 4/2005 Coleman et al. ..... 219/243

OTHER PUBLICATIONS

European Search Report dated Mar. 30, 2006 for corresponding EP 05 02 0585 application.

* cited by examiner

*Primary Examiner*—Ed Tolan
(74) *Attorney, Agent, or Firm*—Kathryn A. Marra

(57) ABSTRACT

A hot forming tool is heated with multiple electrical resistance cartridge heaters. The heaters are located in the body of the tool so as to maintain the entire forming surface within a predetermined temperature range. Numerical thermal and optimization analyses direct the placement of the heaters so that when each heating element is simultaneously powered on for an identical fraction of the time, an acceptable temperature distribution will be produced within the tool at the tool operating temperature.

5 Claims, 2 Drawing Sheets

HEATED DIE FOR HOT FORMING

TECHNICAL FIELD

This invention pertains to heated metal dies or tools for hot forming or molding. More specifically, this invention pertains to such dies in which electrical resistance cartridge heaters are arranged within the tool such that when each heating element is powered on for an identical fraction of the heating time, an acceptable temperature distribution will be produced within the tool at the tool operating temperature.

BACKGROUND OF THE INVENTION

The design and operation of forming tools is particularly challenging in the shaping of large parts at high temperatures. For example, superplastic aluminum and titanium sheet alloys have been formed at temperatures of the order of 500° C. for aluminum and 1100° C. for titanium into one-piece panels or other articles of complex shape. In hot stretch forming, heated blanks of superplastic sheet material are gripped at their edges and placed over the forming surface of a heated tool. One side of the sheet is stretched into compliance with the forming surface, usually by applying gas pressure to the back side of the sheet using a complementary tool.

Presses with heated platens have been used to heat the complementary tools, oven-like, and to move them between open and closed positions. When the press is in its open position a hot finished part is carefully removed and a new hot sheet metal blank inserted. As the press closes the binding surfaces of the tools grip the edges of the blank for gas pressurization and stretch forming. While the blank may be preheated, the tools are heated by the press platens.

Recently, in forming superplastic AA5083 sheet material, internally heated forming tools have been used in unheated conventional hydraulically actuated forming presses. The internally heated forming tool is provided with thermally insulated outside surfaces including its bottom surface (i.e., the surface opposite the forming surface) at which it is attached to an unheated press bed. The heating has been accomplished with electrical resistance heating cartridges embedded in holes bored in the body of the massive cast steel tool. The electrical heater elements are arbitrarily placed near the forming surface for control of the temperature of the tool especially at the forming area. The heater elements have been used in a plurality of separately powered and separately controlled heating zones in order to better control the temperature of the forming surface of the forming tool and the temperature near the forming surface in the gas chamber defining tool. Separate thermocouples are required for each temperature-controlled zone and different zones are often activated at different times in the operation of the tool.

This practice of using many electrical cartridge heaters in many separate electrically powered and controlled heating zones has been very effective in providing reasonably close control of the temperature of the tool forming surface. Such improved temperature control over platen heating has permitted reductions in the time required to hot stretch form automotive inner and outer decklid panels, tailgate panels, and like panels with complex curves and deep recesses. The forming cycle time for successive parts has been markedly reduced, providing increased throughput and better utilization of large, expensive tools and equipment. The insulated, internally heated tools can be preheated outside of the conventional, unheated hydraulic press, and they better maintain forming temperature during prolonged forming operations with the cyclical opening and closing of the press.

However, the use of many separately powered and controlled heating cartridges has proven cumbersome and expensive. Separate temperature sensors (thermocouples) and separate electronic controllers are required for each zone of several heaters. This invention provides a heated forming tool that can be suitably heated with electrical resistance heater elements powered from a single electrical source and controlled using a single temperature measurement as a single zone. It also provides a method of making such an internally heated forming tool. And it provides a method of forming sheet material parts using such a heated tool. These advantages are generally applicable to the forming of materials at elevated temperatures. But they are particularly applicable to the hot stretch forming of sheet metal parts such as automotive body panels using highly formable aluminum sheet metal alloys.

SUMMARY OF THE INVENTION

This invention provides an internally heated forming tool (or die) that has a hot forming surface for shaping hot formable materials. The tool is made of a strong, thermally conductive material such as cast steel and is heated with electrical resistance cartridge heaters. The heaters are placed in the tool and used to heat the body of the tool so that the temperatures experienced over different regions of the forming surface are suitably uniform for the shaping of the material into a useful article. In accordance with the invention, the heater elements are located in the body of the tool so that they can be energized from a single electrical power source and controlled by a single controller. In other words, the location of the heating elements in the body of the tool is predetermined with the goal of maintaining the desired surface temperatures by detecting a temperature at a location on or in the tool and turning all heater cartridges on or off at the same time in response to the measured temperature.

The practice of the invention will be described in connection with the design and manufacture of large steel dies for hot stretch forming of aluminum body panels for automotive vehicles. Such panels have been made using highly formable (superplastic) AA 5083 sheet metal blanks. Given the required shape of the part, a pair of complementary dies can be designed in three-dimensions using commercial computer software. The metal shaping behavior of design iterations of the forming die surface can be evaluated with available metal stamping software. Knowledge of the forming characteristics of the sheet material is used in specifying a temperature range for the forming surface of the die. Then, in accordance with this invention, a heat transfer analysis and an optimization analysis are used to locate heating elements in the body of the die near its forming surface to maintain all forming surface regions within a specified temperature range during repeated openings and closings of the press for part removal and blank insertion.

A preferred goal of the analysis is to position a plurality of heater cartridges within the body of the die so that desired forming surface temperatures can be maintained by sensing the temperature at a selected location within the body or surface for controlling the activation of the cartridges from a single power source. In its simplest and preferred embodiment, all heaters in the die are turned on or off at the same time using a single electronic controller. The electrical heating and control design economizes and simplifies operation of the forming process and the maintenance and replacement of heater elements. The material and dimensions of the die have been established by design. The physical properties of the material, including its thermal conductivity; assumed temperatures at the forming surface of the die and its exposed sides and press (bed or ram) attaching surface; and the dimensions of the die are among the parameters used in the analysis for location of the heaters.

To determine the optimal set points for the cartridge heaters, heat conduction in the die must first be analyzed by some numerical program, such as ABAQUS® or ANSYS® on a suitably programmed computer. The finite-element method is suitable for this purpose. In this well known numerical analysis tool, the domain of the tool is broken into many small mesh elements and heat transfer equations systematically and progressively solved for each element. After specifying appropriate boundary conditions on the die surfaces, this analysis establishes a predictable relationship between the temperatures on the working surface of the die and the control temperatures on the cartridge heaters.

The objective of the design process is to select the control temperatures that make the die surface as uniform as possible. For this purpose an objective function is used. The objective function is expressed as the sum of squares of the difference between the predicted and target temperatures at all the nodes on the die surface. The optimal design is the set of control temperatures that minimizes the objective function, subject to any practical constraints that may exist. The optimal design may be found in one of two ways: either using an optimization algorithm, such as the gradient search method, or when the relationship between the objective function and the design variables is linear, solving directly for the set of design variables that produce a stationary point in the partial derivatives of the objective function.

This practice enables the construction of a massive, internally heated forming die with electrical resistance heaters that can be simply powered and controlled. And the temperature of the forming surface of the tool can be effectively controlled within a useful narrow working range in response to variations in temperature measured at a single location, or relatively few locations, in the die. Simplified and effective temperature control of the forming surface during repeated part forming cycles increases the productivity of the tool and reduces the cost of the parts made on it.

Other advantages of the invention will become more apparent from a detailed description of preferred embodiments which follow.

DESCRIPTION OF THE PREFERRED EMBODIMENT

U.S. Pat. No. 6,253,588 to Rashid et al, and assigned to the assignee of this invention, describes Quick Plastic Forming of Aluminum Alloy Sheet Material. In Quick Plastic Forming (QPF), a blank of superplastic aluminum alloy is heated to the forming temperature and stretched by air pressure against a forming tool to make an aluminum body panel. QPF is a hot stretch forming process, or hot blow forming process like superplastic forming. However, QPF is practiced at a lower temperature and higher strain rates where deformation mechanisms of grain-boundary sliding and solute-drag creep both contribute to material deformation, and total elongations are somewhat less than those obtained for true superplastic behavior. This invention provides improved internally heated forming dies or tools for QPF and other hot forming or molding processes for materials.

Challenges in making internally heated forming dies for automotive body panels arise from the size of the panels (typically generally rectangular and one meter or so on a side) and the resulting size, mass, thermal conductivity of the dies and the complex shapes of their forming surfaces. For example, each forming die typically weighs more than ten thousand pounds and it is common for a matched set of dies to weigh 25,000 to 30,000 pounds. The tools are usually made of cast steel for durability in making thousands of parts. While steel is thermally conductive, its thermal conductivity is much lower than that of, for example, aluminum, with the result that steep thermal gradients can exist in the massive heated die. Forming surfaces, like the panels they shape, have curves and contours in any direction of view. This invention provides a method of locating heater cartridges in such dies.

Figure 1:
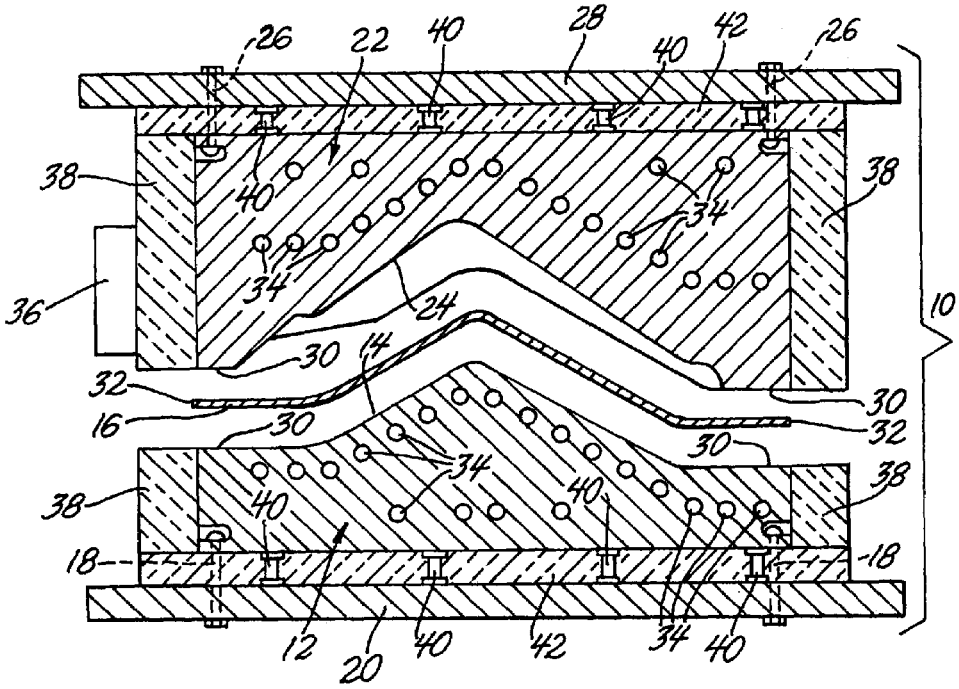
FIG. 1 is a side view in cross-section of upper and lower, internally heated and insulated steel dies for hot stretch forming an aluminum alloy sheet into a body panel for an automotive vehicle.

FIG. 1 is a side view in cross-section of a press attachment plate and die set combination 10 containing two vertically opposing, internally heated dies. Lower die 12 is a forming tool providing forming surface 14 for shaping a preheated blank 16 into a part such as an automotive body panel. Lower die 12 is rectangular in plan view and is attached (bolts 18) to and carried by a steel mounting plate 20 itself attached to the bed of a hydraulically actuated press (not shown). Upper die 22 is aligned with lower die 12 along the vertical closing axis of the press and provides a working gas chamber-defining surface 24. Upper die 22 is attached (bolts 26) to an upper steel mounting plate 28 in turn attached to the ram of the press, not shown.

In a hot forming process preheated aluminum alloy blank 16 is placed between separated dies 12 and 22 during the press-open portion of the forming cycle. The press closes binder portions 30 of dies 12, 22 to grip the edges 32 of the blank material 16 for hot stretch forming. Dies 12 and 22 are internally heated, as will be described in this specification, and maintained at a suitable forming temperature for sheet material. A pressurized working gas is admitted through a duct (not shown) in upper die 22 into a gas chamber formed between chamber-defining surface 24 and the upper side of blank 16 when the tools are closed. Gas pressure is increased in a suitable predetermined schedule to stretch the clamped hot blank 16 against forming surface 14 of die 12. After the material has been carefully formed against surface 14, the press is opened to separate dies 12 and 22 for careful removal of the hot shaped body panel or other part.

In order to form a relatively large part such as a vehicle decklid panel, dies 12 and 22 are suitably formed from blocks of cast steel that are often 2 feet high and 5 feet by 6 feet on their sides. Forming surface 14 and chamber surface 24 are machined in their respective steel blocks in making dies 12 and 22. The massive dies 12 and 22 are each heated by boring holes through their sides and inserting electrical resistance cartridge heaters 34 into the bores from opposing sides of the die blocks 12 and 22. Each cartridge heater may extend across the half-width of the die and have segments of different power level along its length.

Heretofore, the heater elements have been located by engineering judgment and experience reasonably close to the forming surface 14 of die 12 and the chamber defining surface 24 of die 22. The locations of forty heaters (two per hole) 34 in die 12 and forty heaters 34 in die 22 are shown in the cross-sectional view of FIG. 1. Each heater in a die is connected to a source of electrical power through an electrical box 36 (shown only for upper die 22) and external electrical controllers (not shown) which control current delivery to heating cartridges 34. In prior practice, the heater cartridges have been grouped in several different heater zones, four to eight or more in each die block 12 and 22. Each zone requires a temperature sensor, not shown in FIG. 1, and an external controller for management of heater duty cycles and adjustment of the temperature in each heating zone.

In accordance with this invention, a single temperature controller for each die receives temperature data from a single thermocouple located in the die. The controller operates the heaters in its die to maintain the thermocouple within a predetermined temperature range. That thermocouple location and its specified temperature range have been predetermined as the basis for maintaining the entire forming surface 14 of forming die 12 within a suitable temperature range for the rapid but safe forming of the sheet material 16 against forming surface 14. The working gas pressure chamber defining surface 24 of upper die 22 is heated by a specified group of heaters controlled by a single controller based on temperature readings from a suitably located temperature sensor. For example, the forming surface 14 of die 12 and the chamber-defining surface 24 of die 22 may be controlled in a range of 450° C. to about 465° C. for hot stretch forming a 1.6 mm thick blank of fine grained AA 5083 sheet material.

Since the forming tools are very hot it is preferred to thermally insulate them from the press and surroundings. Affixed to each side of complementary dies 12, 22 are packaged insulation layers 38. The nature and thickness of the insulation is chosen to maintain the temperature at its outside surface below about 140° F. during prolonged cyclical operation of the press forming operations. This temperature is specified so other operating equipment may be used to load blanks into the press and unload finished parts, and so that workers can rapidly exchange one hot die for another as production operations may require.

Self-heated tools 12, 22 are operated in conventional hydraulic presses so they are insulated from their respective mounting plates 20, 28 by which they are attached to the bed or ram (not shown) of the press. Tools 12, 22 are preferably spaced from mounting plates 20, 28 and supported on a number of load carrying "spool" shaped, high temperature, high strength and oxidation resistant metal (e.g., INCONEL) columns 40. Columns 40 have relatively low conductivity and the total area and strength of the columns is large enough to support the tonnage applied to tools 12, 22 when forming parts at high temperatures. Low-density ceramic blanket insulation 42 is placed around columns 40 and between the dies 12, 22 and mounting plates 20, 28 to further decrease heat flow. This combination of load carrying spool columns 40 and low-density insulation 42 is preferably used on both the upper and lower halves of the tools, as shown.

In hot die forming, the tool, such as die 12, performs two basic functions: it imparts shape and it supplies heat. In most situations, the second function is more difficult to control because the thermal characteristics of the tool affect a number of aspects of the process. For example, the tool surface, forming die surface 14, must remain hot after the press opens and the dies separate, but not get so hot that it overheats the blank when it is placed in the tool for forming. Tool temperature must be fairly uniform to allow short forming cycles and the formed panel requires a relatively uniform temperature at the time of extraction or it will distort as it cools outside the tool.

Because forming tools are usually used to make more than one part, the thermal disturbance caused by opening and closing the tool to make each panel affects the forming of the next panel, and so on. The tool temperature gradually decreases as more panels are formed, until the process reaches a uniform and periodic state and the tool temperatures become periodic. In a preferred embodiment of the invention, the placement of resistance heaters is determined primarily for such steady state forming operations. Determining and specifying heater location to maintain this steady temperature state is a preferred condition for high volume manufacturing.

A finite-element thermal conduction method, such as ABAQUS® or ANSYS® is used to calculate the periodic die temperatures at steady state. The general validity of this approach requires that the cycle time be short compared with the start-up transient of the process. When this is true, the periodic temperatures in the die penetrate only a short distance below the cavity surface. The die temperatures in massive tools are idealized by assuming that below a certain distance from the cavity surface they are independent of time.

Thermal analysis begins with a tool that has already been designed based on its mechanical function. The part is designed using commercial computer aided design practices. Its forming behavior is then simulated with available stress-strain software. Different design iterations are tried until the software indicates that the aluminum sheet can be formed without tears or splits. Usually the math-data for this surface is then expanded by the tool builder to produce a three-dimensional solid tool. The complete tool design, now in the form of a CAE file, contains a number of small details, such as thermocouple holes, vent holes, wire channels, threaded holes for attachments, and notches for various clearances. Many of these details don't have to be included in the thermal model of the tool.

Figure 2:
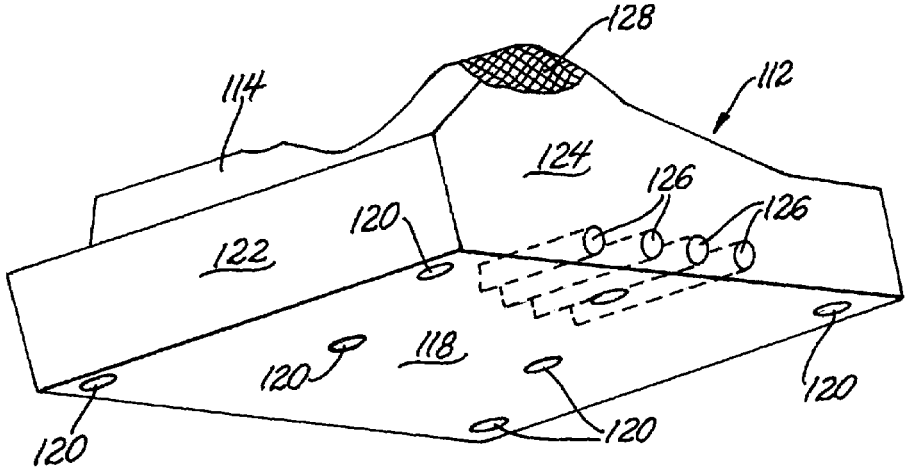
FIG. 2 is an oblique view of a forming die for an inner tailgate panel for an automotive vehicle.

FIG. 2 is an oblique schematic view of a decklid inner panel forming die or tool without its side and bottom insulation packages.

Referring to FIG. 2, steel forming die 112 has a machined forming surface 114 shaped for hot stretch forming of an AA5083 blank into a decklid inner panel. Opposite forming surface 114 is bottom surface 118 for attachment to a press mounting plate like press plate 20 in FIG. 1. Bottom surface 118 would be separated from the press plate by Inconel columns, like columns 40 in FIG. 1 and low density insulation, like insulation layer 42 in FIG. 1. The supporting columns would bear against bottom surface 118 at locations 120. Forming die 112 has side surfaces 122 and 124 visible in FIG. 2. When die 112 is prepared for heating and placement in a press, side surfaces 122, 124 would be encased in insulation packages like packages 38 in FIG. 1. Die 112 would also have bore holes 126 for insertion of electrical resistance heater cartridges. The locations of heater bore holes 126 in FIG. 2 are for illustration, but specific heater locations are to be determined as will be illustrated in connection with the side views of die 112 shown in FIGS. 3 and 4.

The idealized CAE geometry file is exported to finite-element thermal analysis software to create the finite element mesh throughout the portions of the tool to be analyzed. A small portion of such a finite element mesh 128 is shown schematically in FIG. 2. When the tool has a central plane of symmetry the thermal analysis may be applied to only half of the tool geometry. The nominal mesh size for this tool is approximately 15 mm, but this size may vary according to the scale of the included geometric detail. Finer meshes usually produce more accurate results, but at the cost of longer analysis times. The thermal analysis starts with an initial placement of heating elements of known electrical power consumption and temperature characteristics at locations in the die. This initial placement is based on engineering judgment. For purposes of simplifying the numerical analysis, the heater cartridges may be treated as a constant temperature when they are activated. In addition to initially specifying heat sources within the tool, the heat transfer coefficients at the margins of the tool, the boundary conditions, are specified.

Boundary conditions are applied to the surfaces of the finite element model of tool 112 depending on the type of insulation. In this example, there are different boundary conditions for each of four different surface areas: First, the bottom portion 120 of tool 112 in contact with the Inconel cylinders; Second, the bottom portion 118 in contact with blanket insulation; Third the front 124 and sides 122 of the tool, and Fourth, the forming surface 114. These boundaries and the corresponding boundary conditions are pre-determined and used in calculating the surface temperatures resulting from a given placement of electrical heaters. The following table 1 gives illustrative values for the first three boundary conditions for surfaces 1–3.

TABLE I

Boundary Conditions 1 through 3

| | Boundary Conditions | | |
|---|---|---|---|
| | 1 | 2 | 3 |
| Inconel conductivity [W/mK] | 14.5 | | |
| Inconel thickness [m] | 0.10795 | | |
| Insulation conductivity [W/mK] | | 0.12 | 0.12 |
| Insulation thickness [m] | | 0.10795 | 0.127 |
| Air conductivity [W/mK] | | | 0.054 |
| Air thickness [m] | | | 0.0127 |
| Plate conductivity [W/mK] | 31 | 31 | |
| Plate thickness [m] | 0.0635 | 0.0635 | |
| Natural convection HTC [W/m$^2$K] | 1000000 | 1000000 | 10 |
| Effective heat transfer coefficient [W/m$^2$K] | 105.3273 | 1.1091 | 0.7176 |

The forming surface 114 of die 112, which includes both the forming surface and the die addendum, is the area of the tool exposed to a periodic temperature change: ambient air when the tool is opened and hot air when the tool is closed. All other surfaces of the tool have a constant heat loss that depends on the type of insulation covering them. In a suitable thermal analysis model, an assumption is made that no heat is lost from the tool surface when the tool is closed. This is a reasonable assumption because when the tool is closed the small amount of cool air trapped in the cavity is quickly heated to the temperature of the tool surface because of its low heat capacity. The aluminum sheet placed in the tool cavity has been preheated to approximately the same temperature as the tool, and so it neither adds heat nor takes heat away from the tool surface. Therefore, the heat flux on the parting surface is nonzero only when the tool is open. The software calculates the effective steady boundary condition on the parting surface from the total cycle time and the open time.

TABLE II shows the effective heat transfer coefficient on the tool forming surface corresponding to these values.

| Boundary Condition 4 | |
|---|---|
| Cycle Time [Sec.] | 180 |
| Open Time [Sec.] | 40 |
| Emissivity of polish steel | 0.60 |
| View Factor | 0.65 |
| Stefan Boltzman [W/m$^2$K] | 5.67E−08 |
| Ambient Temperature [K] | 298.15 |
| Parting Surface Temperature [K] | 723.15 |
| Radiation resistance | 0.06 |
| Radiation Linearized HTC [W/m$^2$K] | 16.07 |
| Natural convection HTC [W/m$^2$K] | 10.00 |
| Natural Convection Resistance [K/W] | 0.10 |
| Effective heat transfer coefficient when die is open [W/m$^2$K] | 26.07 |

The final boundary condition to be considered is the description of the internal heaters that compensate for heat lost through the tool surfaces. The purpose of this thermal analysis and optimization analysis is to design an integrated tool heating system of resistance heaters assembled into a single controllable zone in the tool (or a half of a tool). The analysis starts with an estimated number of, for example, 19.1 mm-OD-by-762 mm-long (0.75 inch-OD-by-30 inch-long) elements rated at 1350W for heating the tool (or one-half of a tool, if the tool is symmetrical about a centerline). The control system may, for example, use a 480V, 200A power supply.

The fundamental goal in designing the heating system is to distribute heating power evenly over large distances in the tool. Successful balance results in relatively uniform temperatures over large tool volumes controlled from a single thermocouple within each tool or half tool.

The picture is complicated somewhat when an actual three-dimensional tool is considered. To maximize control of the local temperature at the tool working surfaces, the majority of heating elements in the tool are preferably placed with their centerlines nominally offset 75 mm (3 inch) from the interior cavity wall of the tool (providing 67 mm (2.625 inch) of steel between the heater OD and the tool surface). Some compromises must be used during positioning of the heaters because the nominal 75 mm (3 inch) offset must be imposed between a complex three-dimensional surface and a series of linear gun-drilled holes. Generally, the nominal distance was maintained as a minimum except for very local areas.

Although most of the heaters will end up placed near the forming surface of the tool, some additional heaters may be needed farther away in deeper regions of the tool. These heaters function to balance the heat losses in the tool vertical direction. The uniformity of temperature throughout the tool generates more uniform tool dimensions and discourages warping during tool heat-up and at steady state operation.

In the model, two different power intensities can be specified along two different segments of the same heater.

Figure 3:
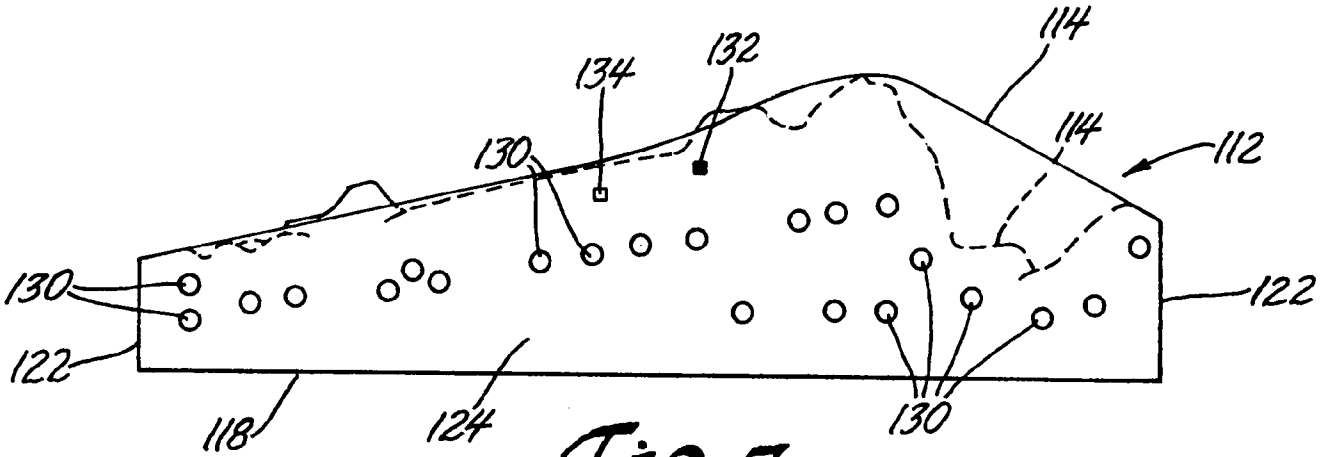
FIG. 3 is a first side view of the die illustrated in FIG. 2 showing a first layout for the location of electrical resistance heater cartridges located in boreholes extending across the die.

FIG. 3 is a side view of die 112 of FIG. 2 showing an initial or intermediate location of twenty-two heater holes 130 extending across the die between opposing sides. A control thermocouple 132 is used inside the tool to indicate when the power to the heaters should be turned on or off to achieve the temperature setting desired at that thermocouple. Each tool or tool half also includes a spare thermocouple 134 that is used should the primary one fail. Heaters 130, control thermocouple 132 and its spare 134 are shown in provisional positions in FIG. 3 prior to a thermal analysis and optimization for better location of these elements in a one-zone heated die design.

Given the initial or provisional location of heaters and the thermocouple, the finite-element software is used to calculate the heater powers for a given set of thermocouple set points.

The finite-element method thermal analysis proceeds to calculate resultant temperatures over the surface 114 of the forming tool 112. A like analysis would be conducted for provisional heater and thermocouple locations in a gas chamber tool (like die 22 in FIG. 1). The resulting temperature map shows the range of temperatures resulting from the initial placement of heaters and their simultaneous activation. To the extent that local surface temperatures are unsuitable, the specified heater numbers and locations are modified and the calculations repeated. This practice is repeated until the heater number and locations produce an acceptable temperature distribution within the tool at its more-or-less steady state operating temperature level. It is preferred that all heaters be located so that the tool is heated by controlling the heaters with a single thermocouple (or as few temperature sensors as possible), and by powering all heaters for an identical fraction of power-on time.

The objective of the design process is to select the heater positions that make the die surface temperatures as uniform as possible. For each heater configuration an objective function is used. The objective function is expressed as the sum of squares of the difference between the predicted and target temperatures at all the nodes on the die surface. The optimal design is the set of control temperatures that minimizes the objective function, subject to any practical constraints that may exist. The optimal design may be found in one of two ways: either using an optimization algorithm, such as the gradient search method, or when the relationship between the objective function and the design variables is linear, solving directly for the set of design variables that produce a stationary point in the partial derivatives of the objective function.

Figure 4:
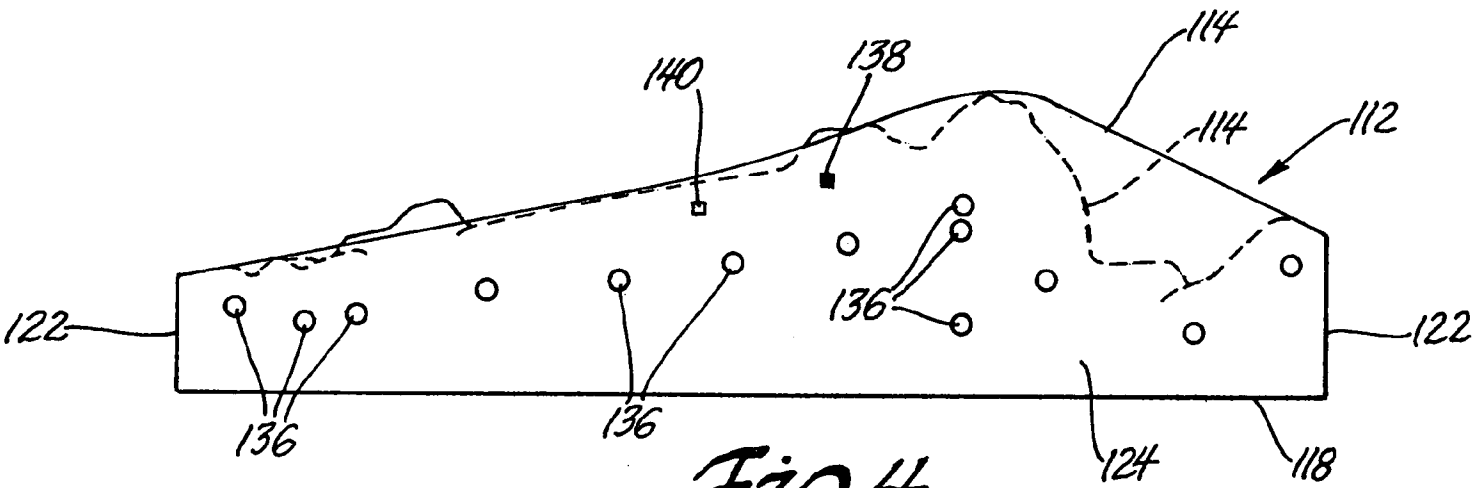
FIG. 4 is a second side view of the forming die illustrated in FIG. 2 showing an optimized layout for the location of a reduced number of electrical resistance heater cartridges.

At the completion of the finite element thermal analysis and optimal design of heater and thermocouple locations and control temperature a design is accepted for use like that illustrated in FIG. 4. The number of heaters 136 has been reduced to thirteen and locations for each of the heaters, the control thermocouple 138 and spare thermocouple 140 are specified. Only one zone of heaters was considered. The heaters may have more than one heater element segment along their lengths with different power ratings which are considered in the numerical thermal analysis.

The range of temperatures experienced in the forming surface 114 during steady state operations was to be centered at about 450° C. In the thermal analysis, the arrangement of thermocouples depicted in FIG. 4 resulted in forming surface temperatures ranging from 443° C. to 459° C. This was considered an acceptable temperature range considering the level of the target temperature. The target temperature for the active thermocouple (at its location) was 454° C. and the target temperature for the spare thermocouple was 453° C.

The thermal analysis estimated that the single-zone thirteen multi-segment heater cartridges would have a power rate of 20380 watts. They would be turned on together for 58.7 second durations during 180 second cycles for a duty time of 32.6%. In comparison, the 22 heaters in the FIG. 3 initial heater/thermocouple arrangement required 36390 watts during 32.9 second heating periods during 180 second cycles (duty time-18.3%).

Such a thermal analysis is used to place heater cartridges and a control thermocouple in a hot forming die for one-zone heater control. The careful placement of the heaters results in simplified heater control systems for operation of the forming tools and, in many instances, lower power consumption.

The practice of the invention has been illustrated in terms of specific embodiments. But the invention is not limited to the illustrated practices.

The invention claimed is:

1. A method of making an internally heated forming tool for forming of sheet materials comprising:

designing a metal tool body having a forming surface for the sheet material, side surfaces and an attachment surface, opposite the forming surface, for attachment to a forming press;

specifying electric power ratings of heating cartridges to be located in the metal tool body of the forming tool for heating the forming surface of the tool;

specifying operating temperatures for the forming surf ace, and heat transfer coefficients for the side surfaces and attachment surface of the tool;

conducting mathematical analyses of the resultant temperatures of locations on the forming surface of the tool for postulated locations of the heating cartridges at their specified power ratings; and optimizing the location of the heating elements to produce a predetermined average temperature of the forming surface and a predetermined range of temperatures of locations on the forming surface.

2. An internally heated forming tool for forming of sheet materials when made by the method recited in claim 1.

3. The method of making an internally heated forming tool for forming of sheet materials as recited in claim 1 additionally comprising identifying a location within the tool body for a single temperature sensor in the body for determining when the electrical heating cartridges are to be powered by the electrical power source for maintaining the sheet material forming temperature at the forming surface.

4. An internally heated farming tool for forming of sheet materials when made by the method recited in claim 3.

5. A method of continually forming a succession of sheet metal articles on the forming surface of an internally heated forming tool for said articles, the method comprising:

designing a metal tool having a forming surface for the sheet metal articles, at least one side surface and an attachment surface, opposite the forming surface, for attachment to a forming press;

specifying electric power ratings of heating cartridges to be located in the body of the forming tool for heating the forming surface of the tool;

specifying operating temperatures for the forming surface, side surfaces and attachment surface of the tool;

conducting mathematical analyses of the resultant temperatures of locations on the forming surface of the tool for postulated locations of the heating cartridges at their specified power ratings;

optimizing the location of the heating elements to produce a predetermined average temperature of the forming surface and a predetermined range of temperatures of locations on the forming surface;

identifying a location within the tool body for temperature measurement for the uses of a single power source and electrical power delivery controller for said heater cartridges to maintain the predetermined average temperature and temperature range of the forming surface of the tool for the forming of the articles; and, thereafter controlling the temperature of the forming surface from said power source during the forming of the sheet metal articles.

* * * * *